US009402282B2

(12) United States Patent
Seegmiller et al.

(10) Patent No.: US 9,402,282 B2
(45) Date of Patent: Jul. 26, 2016

(54) SYSTEM, METHOD AND APPARATUS FOR PULSED INDUCTION HEAT REMOVAL OF COMPONENTS FROM STRUCTURAL ASSEMBLIES

(75) Inventors: Neal A. Seegmiller, Fort Worth, TX (US); Stuart C. Street, Westworth Village, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 2214 days.

(21) Appl. No.: 12/407,005

(22) Filed: Mar. 19, 2009

(65) Prior Publication Data

US 2010/0237054 A1 Sep. 23, 2010

Related U.S. Application Data

(60) Provisional application No. 61/207,867, filed on Dec. 29, 2008.

(51) Int. Cl.
*H05B 1/00* (2006.01)
*H05B 3/42* (2006.01)

(52) U.S. Cl.
CPC ..... *H05B 3/42* (2013.01)

(58) Field of Classification Search
CPC ..... H05B 3/42
USPC ..... 219/229, 220, 230, 233, 238, 674, 676, 219/635, 672, 673, 663, 645, 646, 649, 618, 219/675
See application file for complete search history.

(56) References Cited

U.S. PATENT DOCUMENTS

| | | | | |
|---|---|---|---|---|
| 3,428,769 | A * | 2/1969 | Ciszewski et al. | 219/611 |
| 3,593,001 | A * | 7/1971 | Simpson et al. | 219/243 |
| 4,055,744 | A * | 10/1977 | Fortune | 219/239 |
| 4,690,724 | A | 9/1987 | Outlaw | |
| 6,563,096 | B1 * | 5/2003 | Pacholok et al. | 219/635 |
| 2004/0099659 | A1 | 5/2004 | Johnson, Jr. | |

OTHER PUBLICATIONS

European Search Report and Preliminary Opinion dated Mar. 24, 2010 for EP 09180743.

* cited by examiner

*Primary Examiner* — Phuong Nguyen
(74) *Attorney, Agent, or Firm* — Bracewell LLP; James E. Bradley; Keith R. Derrington

(57) ABSTRACT

A pulsed induction heating system removes bonded elements from underlying substrates. A coil loop of a tool fits around the base of the element to be removed. The tool heats the element and the substrate in short pulses that are followed by brief, non-heated wait periods. The temperature of the substrate is measured during the wait periods between pulses to avoid overheating. When the substrate reaches a target temperature, the adhesive is sufficiently softened such that the element and adhesive are readily scraped off without damaging the substrate.

13 Claims, 7 Drawing Sheets

SYSTEM, METHOD AND APPARATUS FOR PULSED INDUCTION HEAT REMOVAL OF COMPONENTS FROM STRUCTURAL ASSEMBLIES

This application claims priority to and the benefit of U.S. Provisional Patent Application No. 61/207,867, filed Dec. 29, 2008, which is incorporated herein by reference in its entirety.

BACKGROUND OF THE INVENTION

1. Technical Field

The present invention relates in general to removing components from structural assemblies and, in particular, to an improved system, method and apparatus for pulsed induction heat removal of adhesively-bonded components from structural assemblies.

2. Description of the Related Art

In some industrial applications, the parts used to build structural assemblies are formed from different types of materials. These parts may be joined or fastened together in various ways including, for example, conventional nuts and bolts, nutplates that are secured with adhesives, or still other types of fasteners or other assembly elements known by those of ordinary skill in the art.

It is sometimes necessary to remove fasteners or assembly elements, such as to replace incorrect installations or rework the components. Some parts can be damaged during such procedures. For example, substrates formed from composite materials may be damaged by the removal of nutplates or other assembly elements that are bonded to them with strong adhesives. One technique for removing elements from substrates involves physically striking or knocking off the elements from the underlying structure or substrate. When such blows are inflicted at room temperature, they can cause delamination of the composite material. In addition, composite parts can be damaged when personnel use power grinders to remove the residual adhesive left behind on the underlying structure after removal of the elements.

Another technique for removal of adhesively-bonded assembly elements uses a hot air gun to heat the parts and substrate. Prior to heating, thermocouples are installed close to the bond line of the adhesive, and custom-cut silicone masking is installed around the removal site to shield the surrounding elements from the hot air. Some manufacturers of fastener elements, e.g., Click Bond, Inc., also provide removal techniques. Although each of these solutions is workable for some applications, an improved system, method and apparatus for removal of assembly elements from structural assemblies would be desirable.

SUMMARY OF THE INVENTION

Embodiments of a system, method and apparatus for pulsed induction heat removal of assembly elements from structures are disclosed. In one embodiment, the invention comprises a kit containing a heating element, a plurality of removable and interchangeable coils that are pre-formed to fit many types and sizes of fastener elements, a surface temperature probe and thermometer, and a non-metallic scraper to avoid damaging the structural assemblies during removal of the fastener elements and residual adhesive.

In one embodiment, the heating element may comprise a modified, handheld induction heating tool that is used to heat the target element and substrate prior to removal of the element. The tool has a time delay relay to deliver short, intermittent heated pulses that are followed by brief, non-heated wait periods. This cycle reduces the likelihood of overheating the components and allows time for the operator to measure the temperature between the heated pulses. The tool also has a signal light to notify the operator when the tool is delivering a heated pulse.

In one embodiment of a method of the invention, the operator initially selects one of the coils that closely fits around the adhesive base of the element to be removed. The leads of the coil are installed or inserted into the tool, and the loop on the end of the coil is placed around the adhesive base of the element, substantially flush with the underlying substrate. Short pulses of power are then delivered to the loop via the tool, which heats the target element and substrate by induction. The temperature of the substrate may be monitored with a surface thermocouple probe. When the substrate reaches the target temperature, the adhesive is sufficiently softened such that the component and adhesive are easily scraped off. The invention is helpful for the removal of fastener elements from composite, metal and other forms of substrates in some applications, and for the removal of other small bonded parts, such as studs, standoffs, mounts, cable ties, bushings, inserts, etc.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
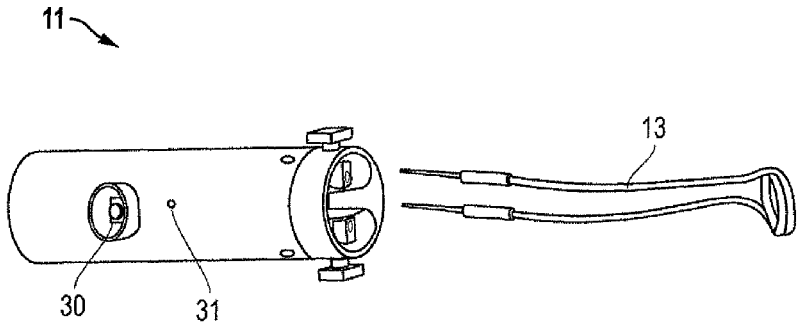
FIG. 1 is an exploded isometric view of one embodiment of a tool constructed in accordance with the invention.
Figure 2:
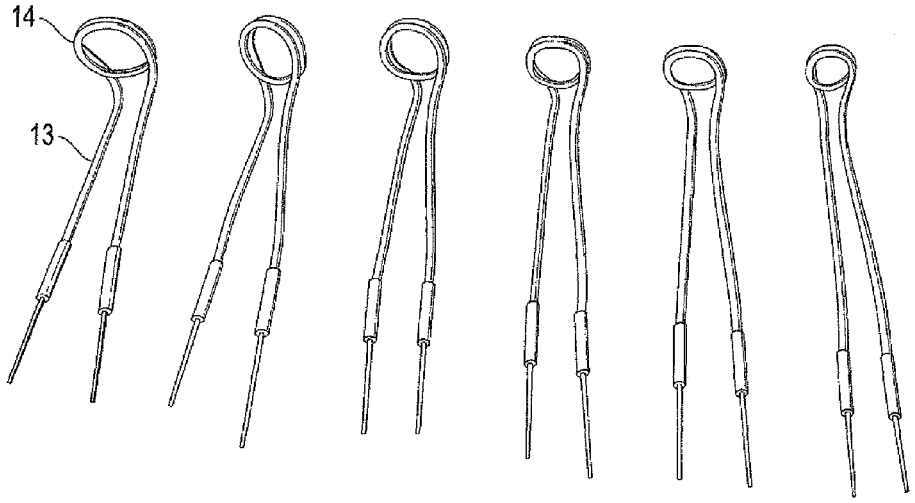
FIG. 2 is an isometric view depicting various embodiments of coils for the tool of FIG. 1 and is constructed in accordance with the invention.

Referring to FIGS. 1-12, embodiments of a system, method and apparatus for pulsed induction heat removal of assembly elements from structures are disclosed. FIG. 1 depicts one embodiment of a heating element or tool 11 that comprises part of a kit or system for use with a method or process of the invention. The kit may include tool 11, a plurality of removable and interchangeable coils 13 (e.g., six shown in FIG. 2) that are pre-formed to fit the most common nutplate types and sizes, a surface temperature probe 15 and thermometer 17 (FIG. 6), and a plastic scraper 19 (FIGS. 8 and 9) to avoid damaging the underlying structure. The kit may contain multiple coil sizes, one designed for each nutplate size (e.g., –3 through –6) and type (e.g., open, domed).

The heating element 11 may comprise, for example, a modified version of a tool known as a Mini-Ductor, which is sold commercially by Induction Innovations, Inc. The tool 11 is a handheld, induction heating device that is used to heat fastener components (see, e.g., nutplates 21 in FIGS. 3, 4 and 7), underlying substrates 23 (e.g., composite substrates) and the adhesive 25 that bonds them, prior to separation. The tool is modified with a time delay relay to deliver short, intermittent heated pulses (e.g., five seconds each) that are followed by brief, non-heated wait periods (e.g., four seconds each). Both the pulse time and the wait time are adjustable for different applications. This cycle reduces the likelihood of overheating the underlying substrate 23 and allows time for the operator to measure the temperature between the heated pulses. As shown in FIG. 1, the tool may be provided with a switch or trigger 30 and a signal light 31 (e.g., an LED) to notify the operator when the tool 11 is delivering a heated pulse.

Figure 10:
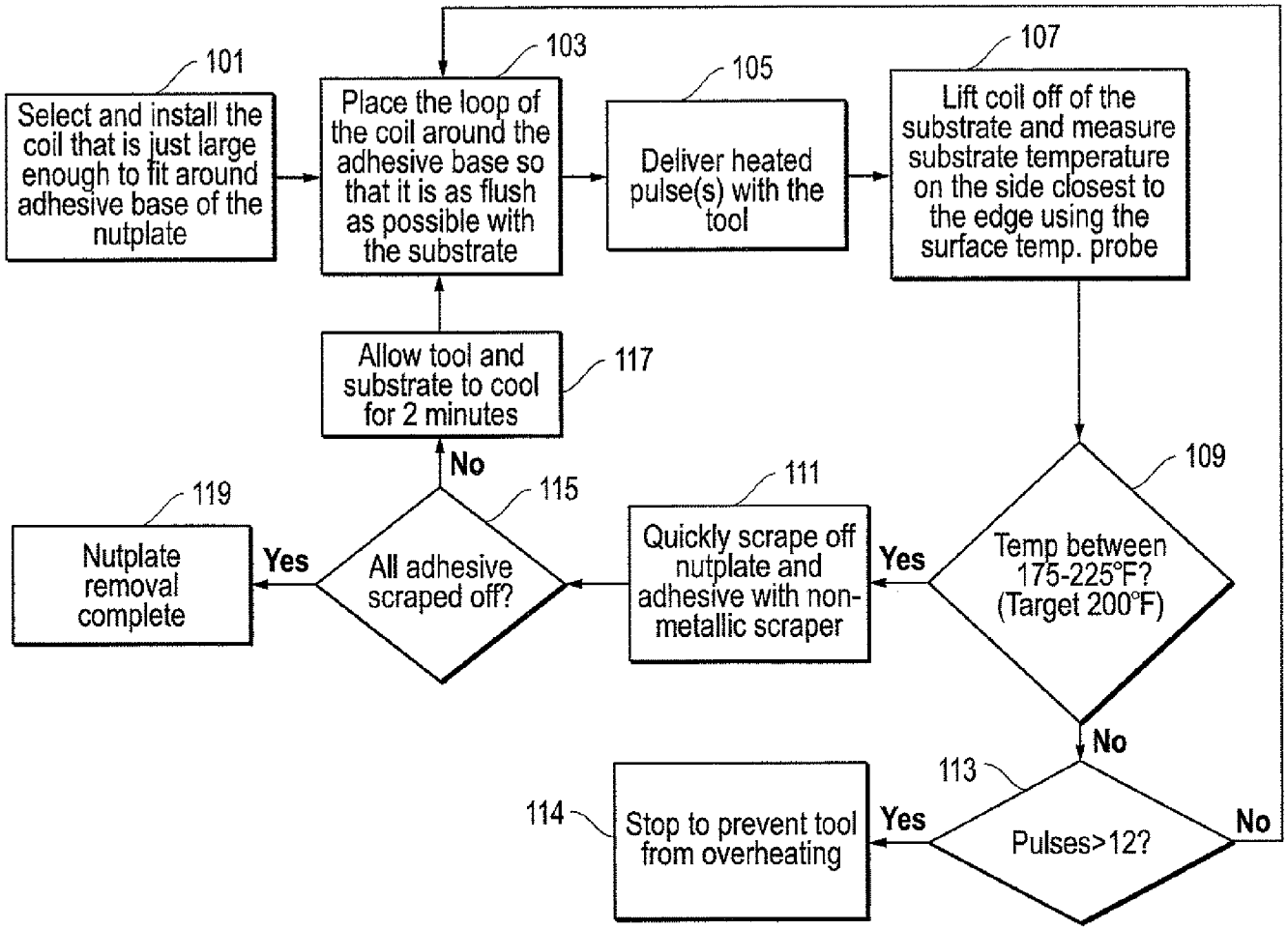
FIG. 10 is a high level flow diagram of one embodiment of a method in accordance with the invention.

In one embodiment of a method of the invention (see, e.g., FIG. 10), the operator initially selects one of the coils 13 (see, e.g., FIG. 2) that closely fits around the adhesive base 25 of the nutplate 21 to be removed (step 101 in FIG. 10). For example, compare the sizes of the various loops 14 on coils 13 in FIG. 2. A coil 13 with a loop 14 is selected so that it is just large enough to fit around the adhesive base 25 of the nutplate 21. For each nutplate 21, the coil loop 14 is selected that best fits, even if that coil is designed for another nutplate size and/or type. The coils may be provided with double loops. The coil loop 14 should not interfere with surrounding nutplates 21 or structure so that it can be as flush as possible with the surface of the composite substrate 23 (step 103). Heating will be less effective if the coil loop is not held flush with the surface. In areas where the nutplate 21 cannot be easily accessed from the front side (see, e.g., FIG. 5), the leads of the coil 13 may be bent back 180 degrees to access the nutplate 21 from the back side of the composite 23. To extend the life of the coil 13, a large bend radius should be used.

Figure 3:
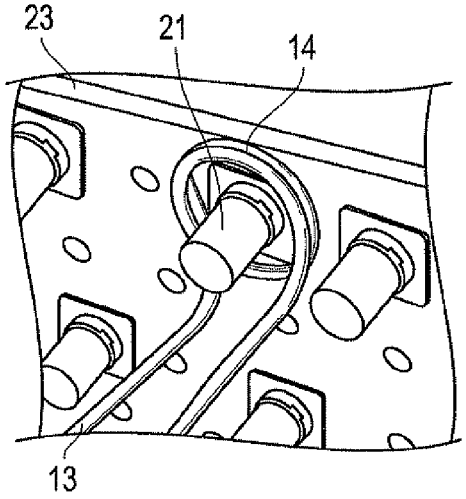
FIGS. 3-5 are isometric views of various embodiments of coils for the tool of FIG. 1 in operation and are constructed in accordance with the invention.
Figure 4:
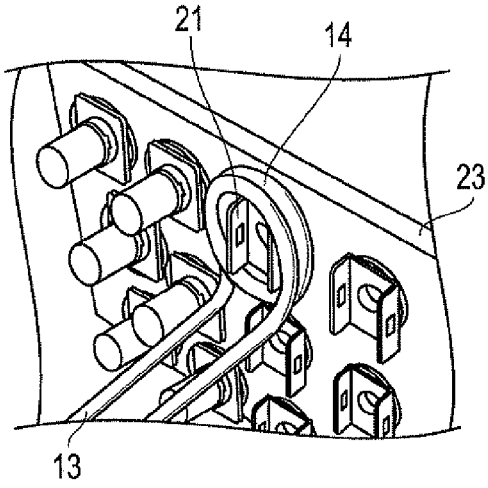
Figure 5:
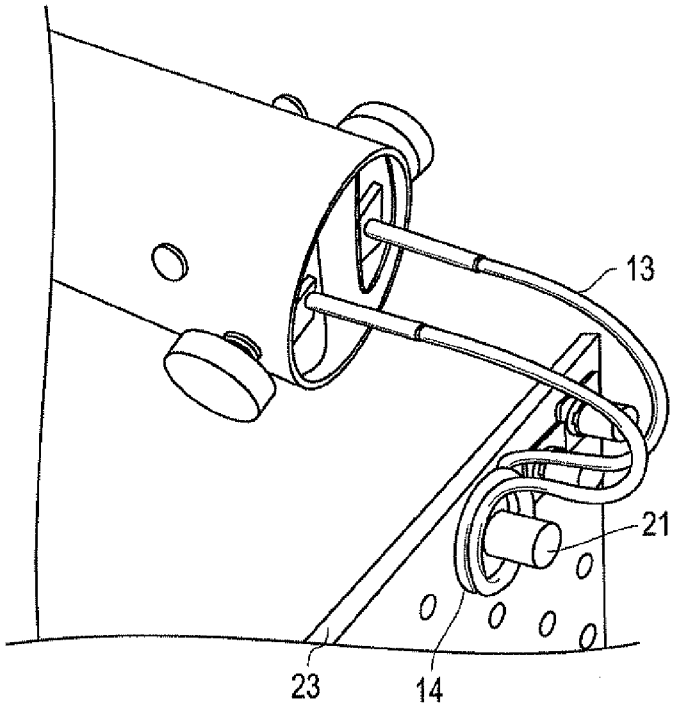
Figure 6:
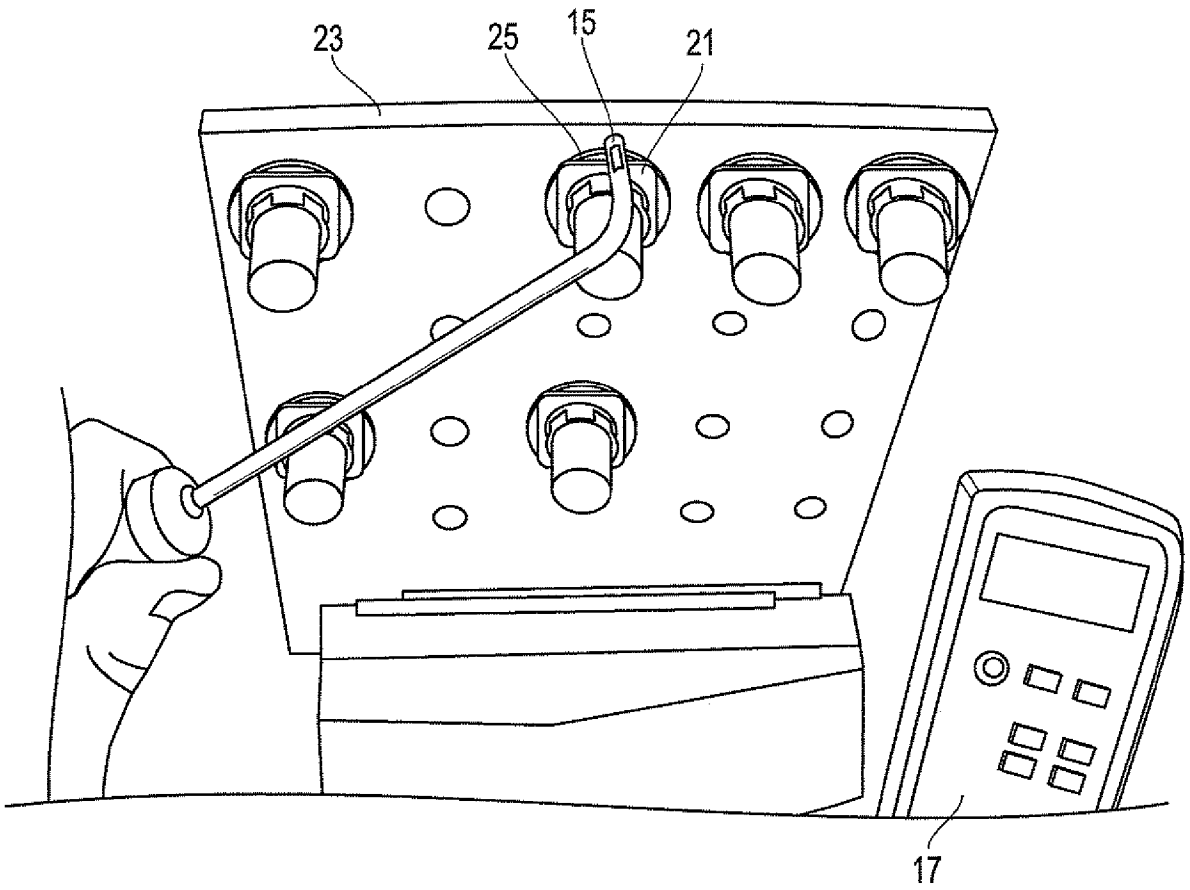
FIG. 6 is an isometric view of one embodiment of a temperature probe in operation and is constructed in accordance with the invention.
Figure 7:
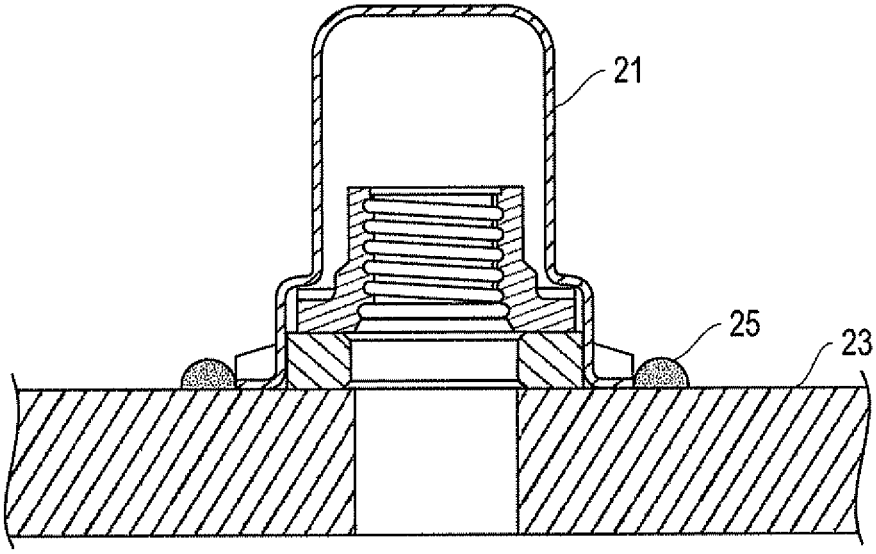
FIG. 7 is a sectional side view of a nutplate mounted to a composite substrate.
Figure 8:
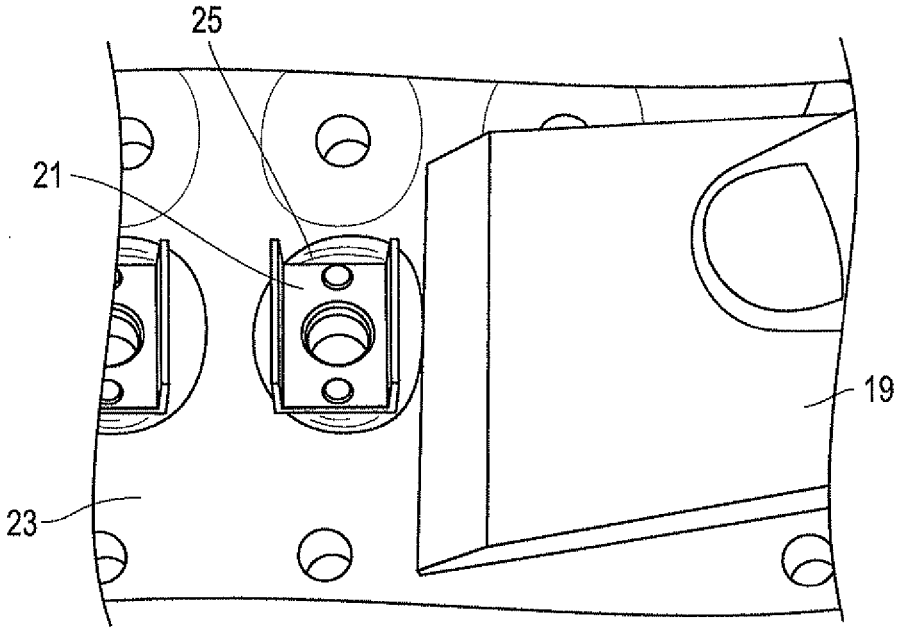
FIGS. 8 and 9 are top views of a nutplate before and after being removed from a composite substrate with a scraper in accordance with the invention.
Figure 9:
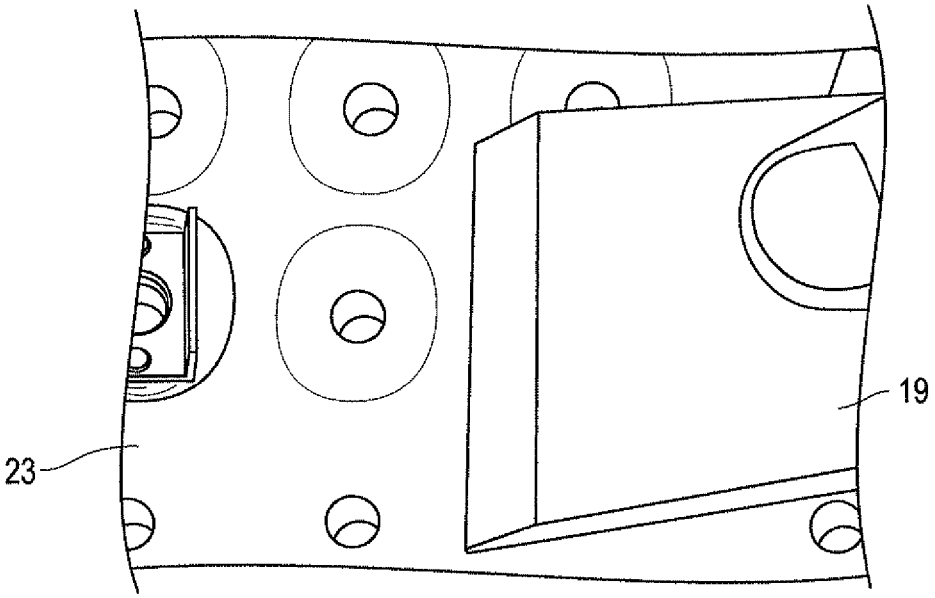

The straight leads of one coil 13 are installed or inserted into the tool 11 (see, e.g., FIG. 5), and the loop 14 on the end of the coil 13 is placed around the adhesive base 25 of the nutplate 21, flush with the substrate 23 (see, e.g., FIGS. 3-5). Short pulses of power are delivered to the loop 14 via the tool 11 (step 105), which heats the target nutplate 21, substrate 23 and adhesive bond 25 by induction with a magnetic field. The temperature of the substrate 23 may be monitored with a surface thermocouple probe 15 (FIG. 6). See, e.g., step 107 in FIG. 10. When the substrate 23 reaches the target temperature (step 109), the adhesive 25 is sufficiently softened such that the nutplate 21 and adhesive 25 can be easily scraped off with the plastic scraper 19 (step 111).

A single pulse of heat may be delivered by pressing and releasing the trigger button 30 (FIG. 1) on tool 11. This action initiates, for example, a five-second pulse of heat. The LED indicator 31 is illuminated whenever the tool 11 is delivering a pulse. Consecutive pulses may be delivered by pressing and holding the trigger button 30. The tool 11 then cycles between five-second pulses and four-second "off" periods until the button 30 is released.

During temperature measurement (see, e.g., FIG. 6), the tip of the surface temperature probe 15 should be placed on the composite surface 23 just outside the adhesive base 25 of the nutplate 21. If the nutplate 21 is near an edge of the part, the temperature on the side closest to the edge of the part should be measured. This area is where the temperature will be hottest. Multiple spots on the composite 23 should be probed to find the highest temperature.

In one embodiment, the operator should stop heating when the temperature of the composite reaches or exceeds about 200° F., or after about 12 pulses (e.g., step 113), whichever comes first. The allowable range for removal is approximately 175-225° F., and should not exceed the maximum allowable temperature for the substrate material. The operator should apply heat for a limited number of cycles to prevent the tool from overheating (e.g., step 114). If after about 12 pulses the temperature has not reached 200° F. but is at least about 175° F., the operator should still attempt to scrape off the nutplate 21 and adhesive 25, in some embodiments.

Referring again to FIGS. 8 and 9, the scraper 19 is preferably non-metallic to avoid damage to the composite substrates. The edge of the scraper 19 is placed flush with the composite surface 23 at the edge of the adhesive base 25. The adhesive base 25 and nutplate 21 are then simultaneously scraped off. If heated properly, the adhesive and nutplate should scrape off with a moderate amount of pressure. Larger nutplates (e.g., sizes –5 and –6) may require greater pressure. For larger nutplates it may be easier to first knock off the heated nutplate then scrape the adhesive base. Multiple passes with the scraper may be required to remove as much adhesive as possible. Since composite parts cool quickly, scraping should be finished within about 5 to 10 seconds of heating (step 119). If all adhesive is not removed with the nutplate on the first attempt (step 115), the composite and adhesive may be reheated after cooling (step 117) and scraped by the same process.

Figure 11:
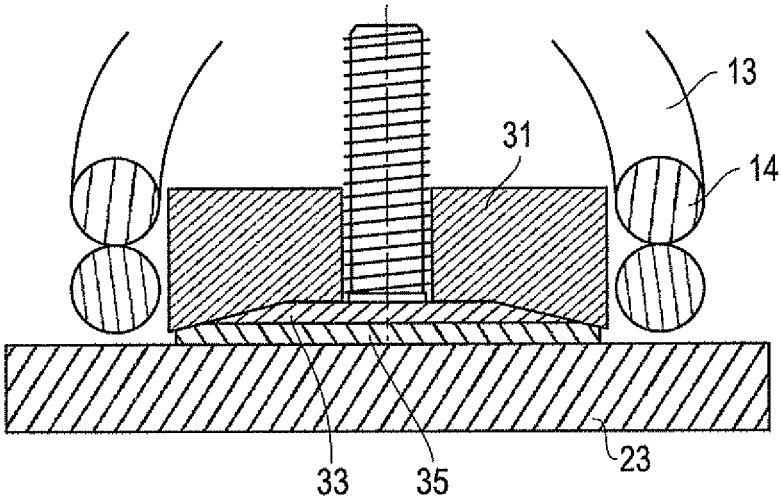
FIGS. 11 and 12 are sectional side views of alternate embodiments of a system, tool and method constructed in accordance with the invention.
Figure 12:
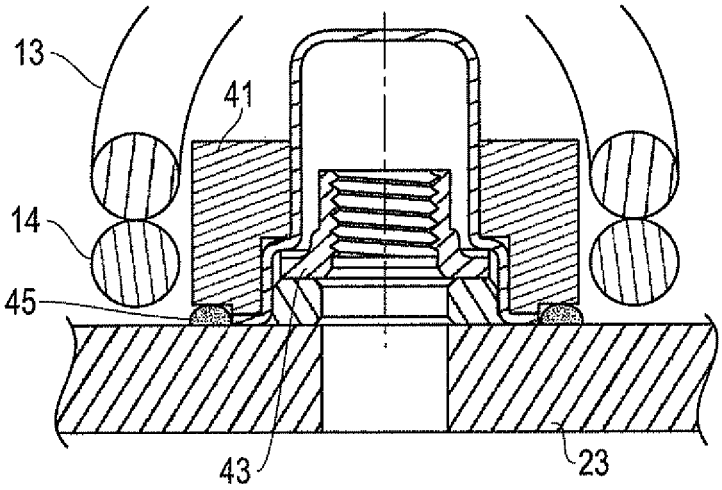

FIGS. 11 and 12 illustrate alternate embodiments of the invention for still other types of applications where the bonded part (e.g., the stud, nutplate, etc.) and/or the substrate are not easily heated by induction. For these types of applications, an adapter or extender 31 may be used to facilitate part removal. The extender 31 may be formed from a material that is readily heated by induction, such as an iron-based metal (e.g., steel). In some embodiments, the extender is formed from a single piece of material, and may be formed in a shape that is complementary to the target component to be removed (e.g., cylindrical in the case of the stud extender 31).

The extender 31 may be mounted directly to the bonded part, e.g., stud 33 in FIG. 11. The loop 14 of the coil 13 is placed around the extender 31, and the extender 31 and substrate 23 are heated by induction. Heat is transferred from the extender 31 to the bonded part 33 and adhesive base 35 by conduction until the target temperature for removal is reached. In the case of bonded stud 33 (e.g., FIG. 11), the extender 31 may incorporate internal threads such that it can be threaded onto the stud 33. For improved heat transfer, the base of the extender 31 is configured in shape and size to make direct contact with the entire base of the stud 33, nutplate, etc. The extender 31 need not encapsulate the entire fastener component. The primary objective is to heat the adhesive 35 at the extended base of the stud 33. Heating the top of the fastener component is not necessarily required.

FIG. 12 depicts an embodiment of the extender 41 for a domed nutplate 43 that is bonded with adhesive 45 to substrate 23. The features and advantages of the invention described herein apply equally to this embodiment. Again, the internal and lower surfaces of the extender 41 may be configured complementary in shape and form to the target part 43 to be removed.

The invention has numerous advantages. Temperature measurement with the invention is simpler and more accurate than that provided by prior art techniques. Thermocouples no longer need to be installed at the bond line of the adhesive; rather, the quick-response surface temperature probe is simply pressed against the composite surface between the heated pulses. Also, unlike prior art techniques, there is no excess hot air discharged on the probe to distort its temperature readings. No silicone or metallic masking or shielding is required since heating is isolated to within the loop of the coil. Heating of surrounding nutplates and structure is negligible, so the surrounding structure is unlikely to be damaged and is not a safety hazard.

The invention also reduces the overall process for nutplate removal to only a few minutes. In contrast, prior art techniques require a much longer and extensive set up for installation of thermocouples, fabrication of shielding, and require more time for heating by hot air. By using induction heating, the invention exposes the composite substrate to high temperatures for a shorter period of time than with hot air, thereby making damage to the composite less likely. The handheld tool and flexible coils can reach and heat fasteners in tight or limited access locations where a hot air gun cannot reach. The invention is helpful for the removal of fastener elements from composite, metal and other forms of substrates in some applications, and for the removal of other small bonded parts, such as studs, standoffs, mounts, cable ties, bushings, inserts, etc.

While the invention has been shown or described in only some of its forms, it should be apparent to those skilled in the art that it is not so limited, but is susceptible to various changes without departing from the scope of the invention.

We claim:

1. A method of removing a fastener component that is adhesively bonded to a substrate, comprising:

(a) providing a tool with pulsed induction heating and a selection of coils that are mountable to the tool, each of the coils having a loop with a different inner diameter;

(b) selecting one of the coils in which the inner diameter of the loop is larger than a footprint of the fastener component;

(c) inserting leads of the selected coil into the tool and positioning the loop of the selected coil around the fastener component, adjacent to a surface of the substrate;

(d) pulsing the tool to heat the fastener component, substrate and adhesive, wherein pulsing the tool comprises closing a switch, which while the switch is closed, causes the tool to provide a plurality of pulses in which inductive electrical power is supplied to the selected coil, each of the pulses being followed by a wait period in which inductive electrical power is not supplied to the selected coil;

(e) detecting a temperature of the substrate;

(f) repeating steps (d) and (e) until the substrate reaches a target temperature and the adhesive is softened; and then (g) scraping the component and adhesive from the substrate.

2. The method according to claim 1, wherein in step (d) each of the pulses has a multiple second duration, and each of the wait periods has a multiple second duration.

3. The method according to claim 1, wherein step (e) comprises positioning a tip of a surface temperature probe on the substrate just outside of the adhesive.

4. The method according to claim 1, wherein step (f) comprises terminating heating of the substrate when a temperature thereof reaches or exceeds about 200° F., or after about 12 pulses of heat, whichever comes first.

5. The method according to claim 4, wherein a temperature range for the substrate is approximately 175-225° F., not to exceed a maximum allowable temperature for the substrate material.

6. The method according to claim 1, wherein step (g) comprises completing scraping within about 5 to 10 seconds of step (f).

7. The method according to claim 6, further comprising cooling the substrate if the adhesive is not removed with the component after step (g).

8. The method according to claim 1, wherein step (c) further comprises mounting an extender directly to the component, and positioning the loop around the extender and the component, the extender comprising an annular member having a hole into which a portion of the fastener extends, the extender being of an iron-based material such that the loop inductively heats the extender.

9. The method according to claim 8, wherein the extender is formed from a single piece of material, and has a mating surface that contacts the component and is complementary in shape to the component.

10. A method of removing a fastener component that is adhesively bonded to a substrate, comprising:

(a) providing a tool with an inductive coil comprising a loop of at least one turn, the coil having a pair of conductive leads extending from the loop and having contact ends electrically joined to the tool;

(b) placing the loop over and around the fastener component into substantial contact with the substrate;

(c) closing a switch to supplying electrical power to the tool, which causes circuitry within the tool to supply pulses of electrical power from the tool to the coil to heat the fastener component, substrate and adhesive, each of the pulses lasting multiple seconds and being followed by a wait period of multiple seconds; and (d) when the adhesive has softened, removing the fastener component and adhesive from the substrate.

11. The method according to claim 10, wherein:

the fastener component has a base adhesively mounted to the substrate and a threaded portion protruding from the base; and step (b) further comprises providing an extender having a hole and placing the extender over the fastener component in contact with the base with the threaded portion extending into the hole and with the loop encircling the extender, the extender being of an iron-based material such that the loop inductively heats the extender.

12. The method according to claim 10, wherein the extender is formed from a single piece of material, and has a mating surface that contacts an outer surface of the base of the component and is complementary in shape to the outer surface of the base of the component.

13. A method of removing a fastener component having a base that is adhesively bonded to a substrate, the fastener component having a threaded portion extending upward from an upper surface of the base, the method comprising:

(a) providing a tool with an inductive coil comprising a loop of at least one turn, the coil having a pair of conductive leads extending from the loop and having contact ends electrically joined to the tool;

(b) providing an extender of an iron based material having a lower surface and a hole extending upward from the lower surface, and placing the lower surface of the extender in contact with the upper surface of the base of the fastener component;

(c) placing the loop over and around the extender;

(d) supplying electrical power from the tool to the coil to heat the extender, the fastener component, substrate and adhesive; and (e) when the adhesive has softened, removing the fastener component and adhesive from the substrate.

* * * * *